US005623728A

United States Patent [19]

Wagner

[11] Patent Number: 5,623,728

[45] Date of Patent: Apr. 29, 1997

[54] HOCKEY GOALTENDER'S BODY PAD WITH SIZE ADJUSTMENT

[75] Inventor: Steven G. Wagner, Kitchener, Canada

[73] Assignee: Canstar Sports Group, Inc., Canada

[21] Appl. No.: 386,539

[22] Filed: Feb. 10, 1995

[30] Foreign Application Priority Data

Feb. 11, 1994 [CA] Canada ..... 2115524

[51] Int. Cl.[6] ..... A41D 13/00

[52] U.S. Cl. ..... 2/462; 2/16; 2/44; 2/463; 2/464; 2/465; 2/467

[58] Field of Search ..... 2/2, 16, 44, 45, 2/908

[56] References Cited

U.S. PATENT DOCUMENTS

| | | | |
|---|---|---|---|
| 4,501,023 | 2/1985 | Bilberry | 2/2 |
| 4,590,622 | 5/1986 | Wolfe et al. | 2/2 |
| 4,610,035 | 9/1986 | Mattila | 2/2 |
| 4,697,285 | 10/1987 | Sylvester | 2/2 |
| 5,007,108 | 4/1991 | Laberge et al. | 2/2 |
| 5,065,457 | 11/1991 | Henson | 2/2 |
| 5,204,993 | 4/1993 | Siemens | 2/2 |

*Primary Examiner*—Michael A. Neas

*Attorney, Agent, or Firm*—Finnegan, Henderson, Farabow, Garrett & Dunner, L.L.P.

[57] ABSTRACT

The invention relates to a protective gear having a primary front protective pad and a rear protective pad, the front and rear pads being flexibly connected to one another and being adjustable relative to one another. This allows the primary front protective pad to extend to a greater or lesser extent downwardly over the player's abdomen, so as to accommodate the desired positioning of the front protective pad on the player's body. The protective gear also has arm sections that are adjustable in length to permit desired positioning on the player's arms. In a variant, the protective gear of the invention also has an adjustable secondary front pad which is attached to the primary front pad and the rear pad and which is configured to cover the player's upper chest and clavicle areas. The protective gear according to the invention is particularly useful for ice hockey players and particularly goaltenders.

5 Claims, 9 Drawing Sheets

HOCKEY GOALTENDER'S BODY PAD WITH SIZE ADJUSTMENT

BACKGROUND OF THE INVENTION

This invention relates to body pads for use as protective gear for a goaltender or other player in ice hockey, and possibly other sports.

In the past conventional protective gear for goaltenders has often consisted of shoulder pads, a separate chest protector, and separate elbow pads. Recently, advances in protective gear for goaltenders have resulted in one-piece units that incorporate all of these previously separate pieces of equipment.

To ensure proper fitting, these new one-piece units are typically offered in a range of chest sizes to accommodate players of different physiques. Due to the wide variety of physiques however, this can lead to grossly misfitting equipment.

For example, the common sizing arrangements require a 5'4" player with a medium chest size and a 6'2" player, also with a medium chest size, to use the same size of one-piece protective gear. This is unsatisfactory in many ways, and can lead to inhibited athletic performance and possibly even injury.

One of the most important considerations in the proper fitting of protective gear for goaltenders in ice hockey is the length of the pads, primarily being the length of the chest/abdominal pads and the length of the shoulder/arm pads. The appropriate length of the pads is partially personal preference based on goalie style, partially dictated by the physical stature of the player, and is partially a function of the configuration of the other equipment used by the player.

In general, the bottom of the chest/abdominal pad should meet or slightly overlap the top of the protection cup when the player is in the crouch position. The chest/abdominal pad should be sized in conjunction with the shoulder/arm pad and goal pants to ensure full coverage protection and resistance-free motion.

The shoulder and elbow caps should be positioned directly on the shoulder and elbow tips respectively. Arm lengths should be determined in conjunction with the catch glove and blocker. In the relaxed state, with the arms at the sides, the shoulder/arm pad should go into the cuff of the goal glove and blocker no more than approximately one and one half inches (1½"). If the shoulder/arm pads extend any further into the goal glove and blocker, binding may possibly result with a subsequent restriction of motion.

One factor effecting the desired positioning of the chest/abdominal pads is the length of the player's torso. A player who is taller than average, or one with a longer torso than average for individuals of a certain chest size, could have insufficient pad length to cover portions of the lower abdomen and the upper front hip area. Thus a length adjustment for the chest/abdominal pad would be beneficial.

Conversely, a player with a shorter torso could find the front pads too long which might interfere with movement, inhibiting performance. Hence, a method of shortening front pad length would be desirable.

The positioning of the chest/abdominal pads is also effected by configuration of the other equipment worn by the player. For example, protective gear for hockey goaltenders also typically includes a form of neck protector. Some neck protectors are larger than others and to be properly fitted with the chest/abdomen and back pads, require a slightly larger opening in these pads around the neck area. Thus it would be desirable to have the ability to adjust the position of the front pad relative to the back pad to permit a larger or smaller opening in the neck area to fit properly with different configurations of neck protectors.

With respect to proper fit of the shoulder/arm pads, there are several reasons why a player may want to increase or decrease arm length. Obviously, many players with the same chest sizes will have different arm lengths. Therefore, some players with longer arms may find their lower arm and wrist areas partially exposed, while other players may find that these pads extend too far down the arm and interfere with the operation of the blocker and catch glove. Both situations could effect performance and might possibly lead to injury.

It is possible, and even likely, that a player may even desire to adjust the arm lengths so one arm is longer than the other. This would be desired if for example the particular model of blocking glove preferred by a player was somewhat longer than similar gloves, and therefore extended further up the player's arm. To achieve the proper fit of approximately a one and one-half inch overlap between glove and pad, the length of shoulder/arm pads would have to be reduced. Proper fit would then necessitate one arm being shorter than the other, which could not be accommodated in conventional gear.

Often the catch glove and blocker are purchased as separate items. If a player is replacing either of these, the new model may be configured differently, again possibly requiring an adjustment to the arm length of the protective gear.

The adjustment of a goaltenders protective gear would also be beneficial in situations such as minor hockey and children's leagues where expensive equipment such as this is sometimes "team equipment." In these situations the protective gear must be worn by different players in each season and it is quite possible that these players will have different statures. It is in the junior and minor hockey leagues were the safety aspect of proper fitting protective gear is particularly desirable.

With current one-piece protective gear it is often impossible to achieve the proper and desired fit for many players. Conventional one-piece units offer little or no adjustments in these areas described, often leaving the gear ill-fitting, and sometimes unsafe. There is therefore a need for a one-piece protective gear that includes the necessary adjustments means to fit players of differing statures.

SUMMARY OF THE INVENTION

In view of the above, it is an object of the invention to provide a one-piece protective gear for goaltenders which provides improved utility and safety by providing an adjustable fit in many ways.

Accordingly, in the invention, the protective gear for an ice hockey goaltender includes a primary front protective pad securable to a player and generally configured to cover a portion of the player's chest and to extend downwardly to cover a portion of the player's abdomen. The gear also includes a rear protective pad securable to a player and generally configured to cover a portion of the player's back, the front and rear pads being flexibly connected to each other by at least one flexible connection to form a single "bib-like" unit to be worn by the player. At least one of the front pad, the back pad or the flexible connection is provided with adjustment means to permit the secured position of said front pad to be varied in relation to the player's body, permitting said front protective pad to extend to a greater or lesser extent downwardly over the player's abdomen, so as to accommodate desired positioning of said front protective pad on the player's body.

An adjustable secondary front pad is also provided which is attached to the primary front pad and the rear pad and which is configured to cover the player's upper chest and clavicle areas.

Arm sections of the protective gear are also individually adjustable in length to allow proper positioning of elbow pads over the elbow joint, and in general to permit desired positioning of arm sections on the player's arm.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
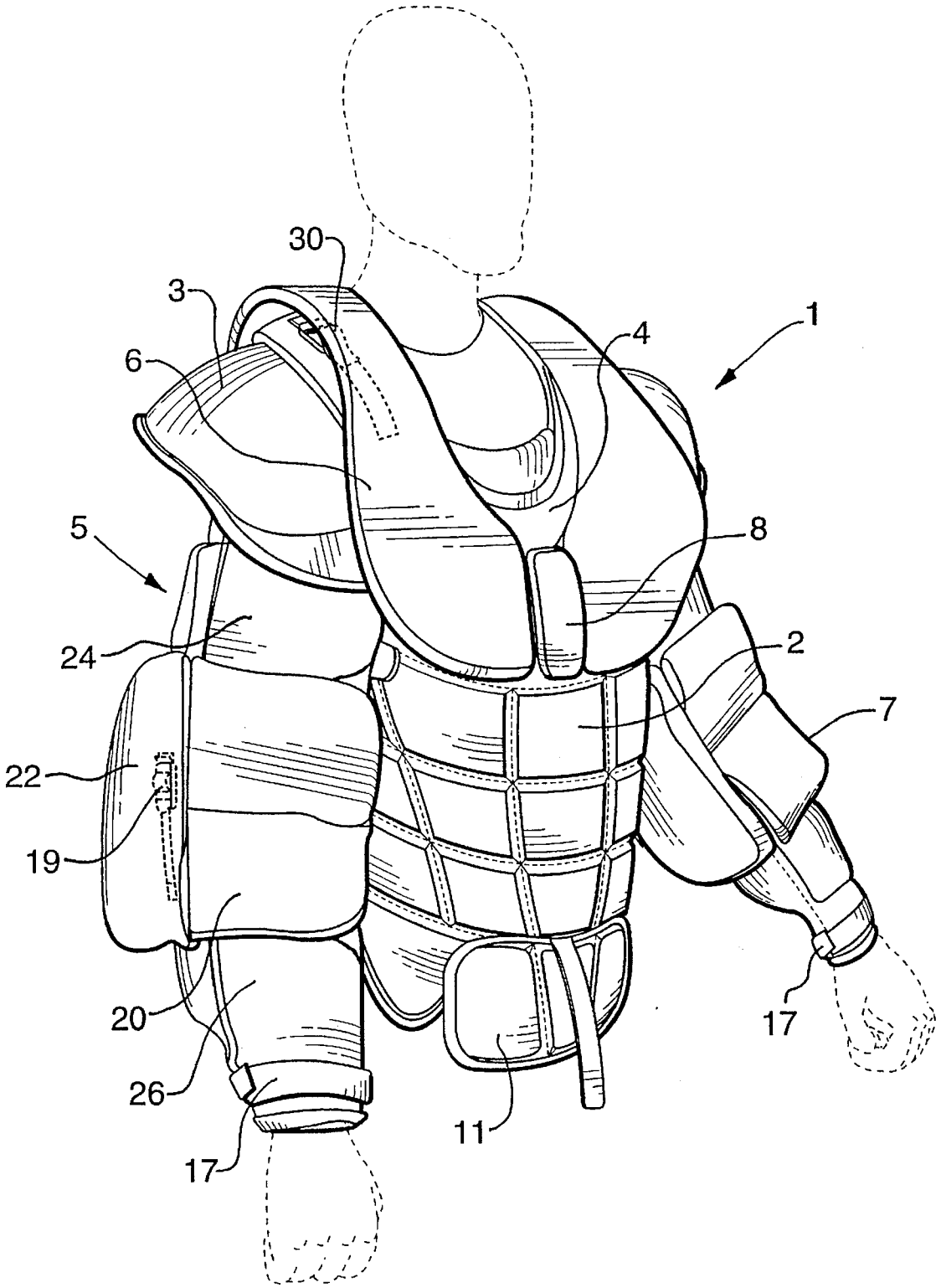
FIG. 1 is a perspective view of the protective gear shown as worn by a hockey goaltender.

Referring to the drawings generally, the protective gear 1 includes a primary front pad 2, which includes a lower abdomen section and belly pad 11, and an chest section 4. The primary front pad 2 is flexibly connected with flexible connections such as fabric seams, (not shown) to a back pad 14. So attached, the primary front pad and the back pad form a single "bib-like" unit, to be worn around the player's neck.

Figure 6:
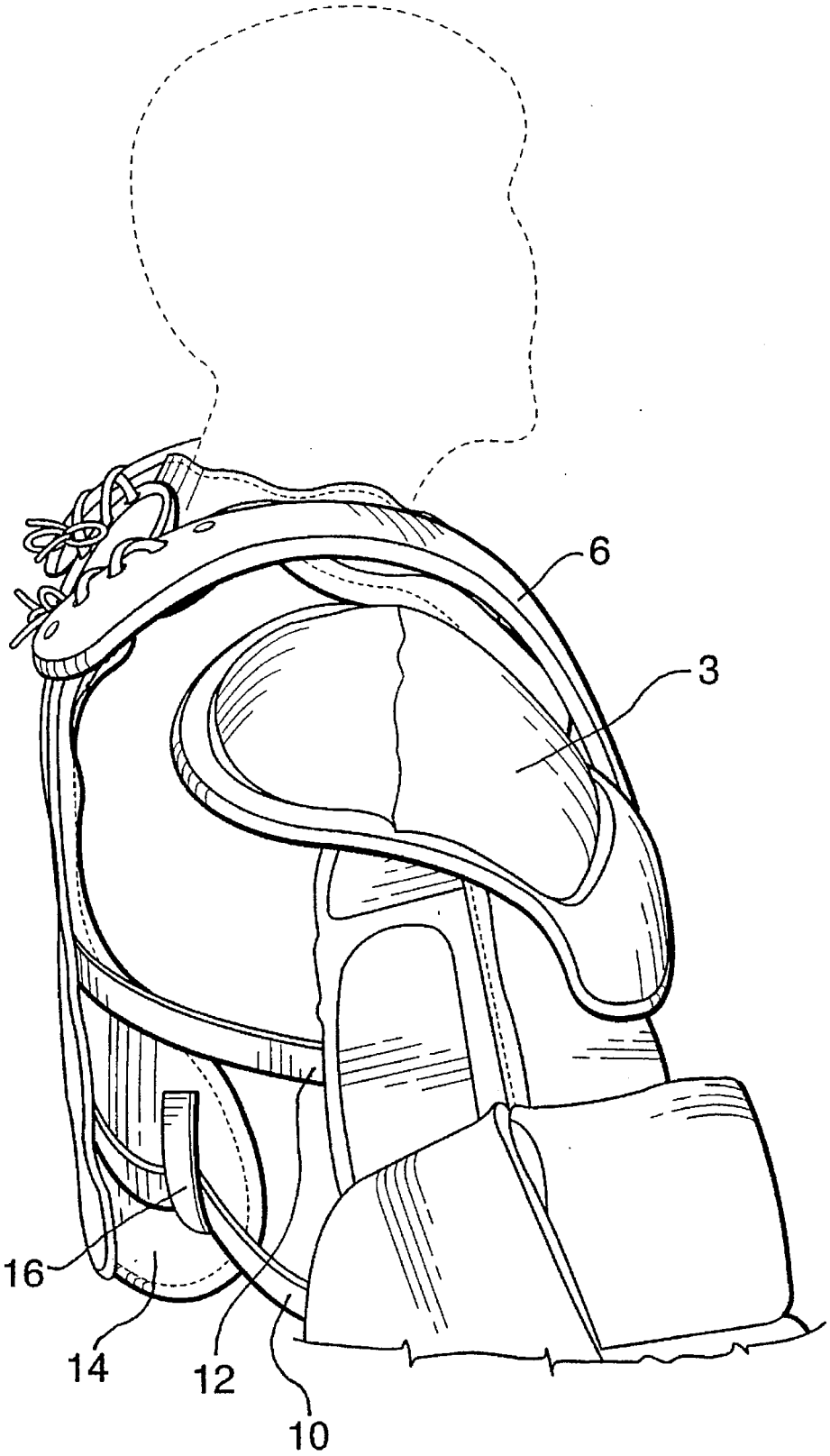
FIG. 6 is a partial side and rear view of the protective gear.

The primary front pad 2 is positionable over the player's chest and abdomen area and is securable to the player's body via straps 10 and 12, as shown in FIG. 6. The said straps pass through loops 16 in a back pad 14 which is positioned over the player's back generally along the spine.

Referring to FIG. 1, a secondary front pad 6 is provided, being configured to cover the player's upper chest and clavicle areas. In the preferred embodiment shown in the drawings, and in particular FIG. 1, the secondary front pad is provided in the form of two clavicle floaters 6, with sternum pad 8 located therebetween. The secondary front pad is positioned over the chest section 4 of the primary front pad 2, and is flexibly connected with flexible connections, such as fabric seams (not shown), to the primary front pad 2, near the sternum pad 8.

Figure 7:
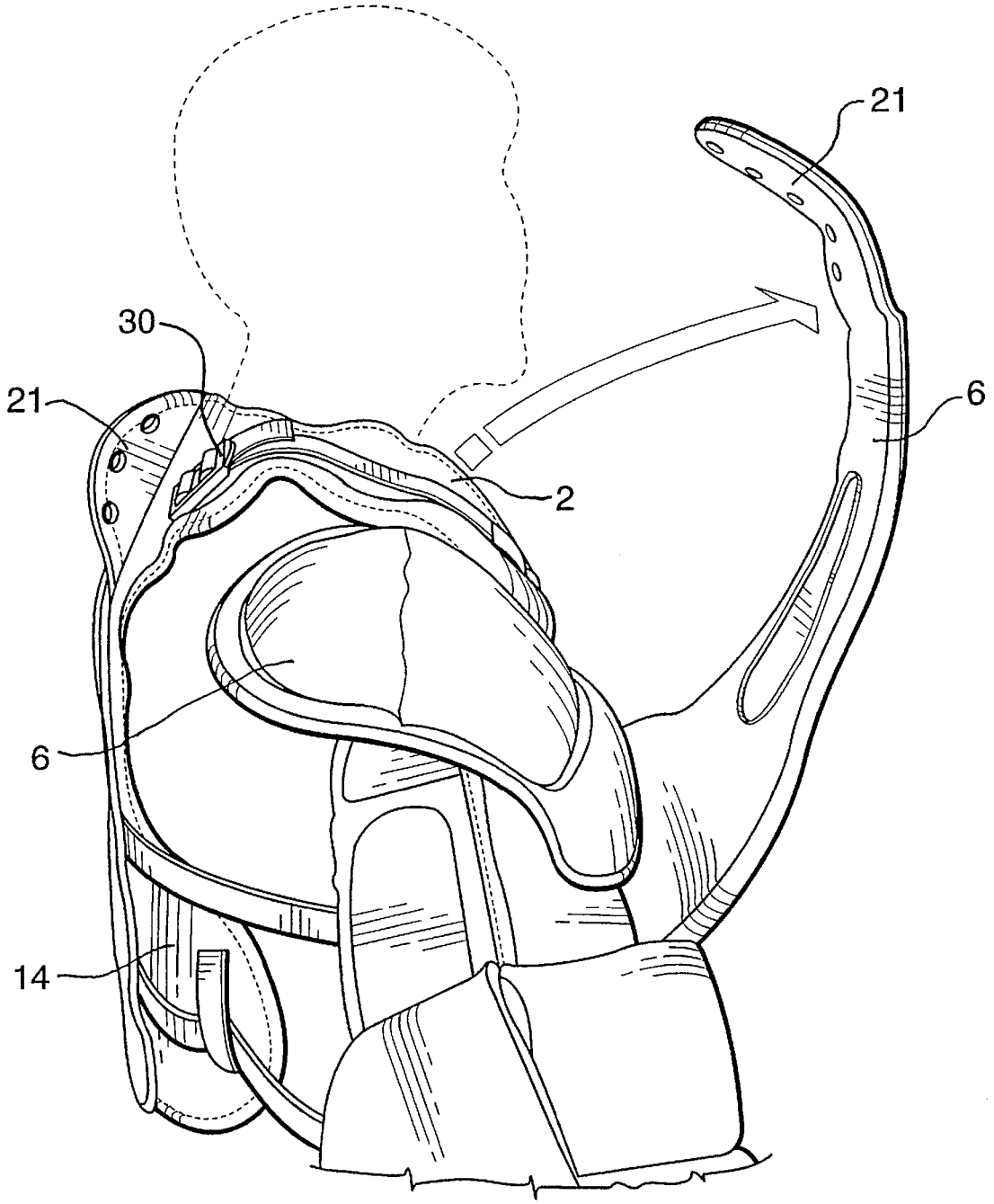
FIG. 7 is a partial side and rear view of the protective gear showing the primary front pad adjustment means in an unadjusted position.
Figure 8:
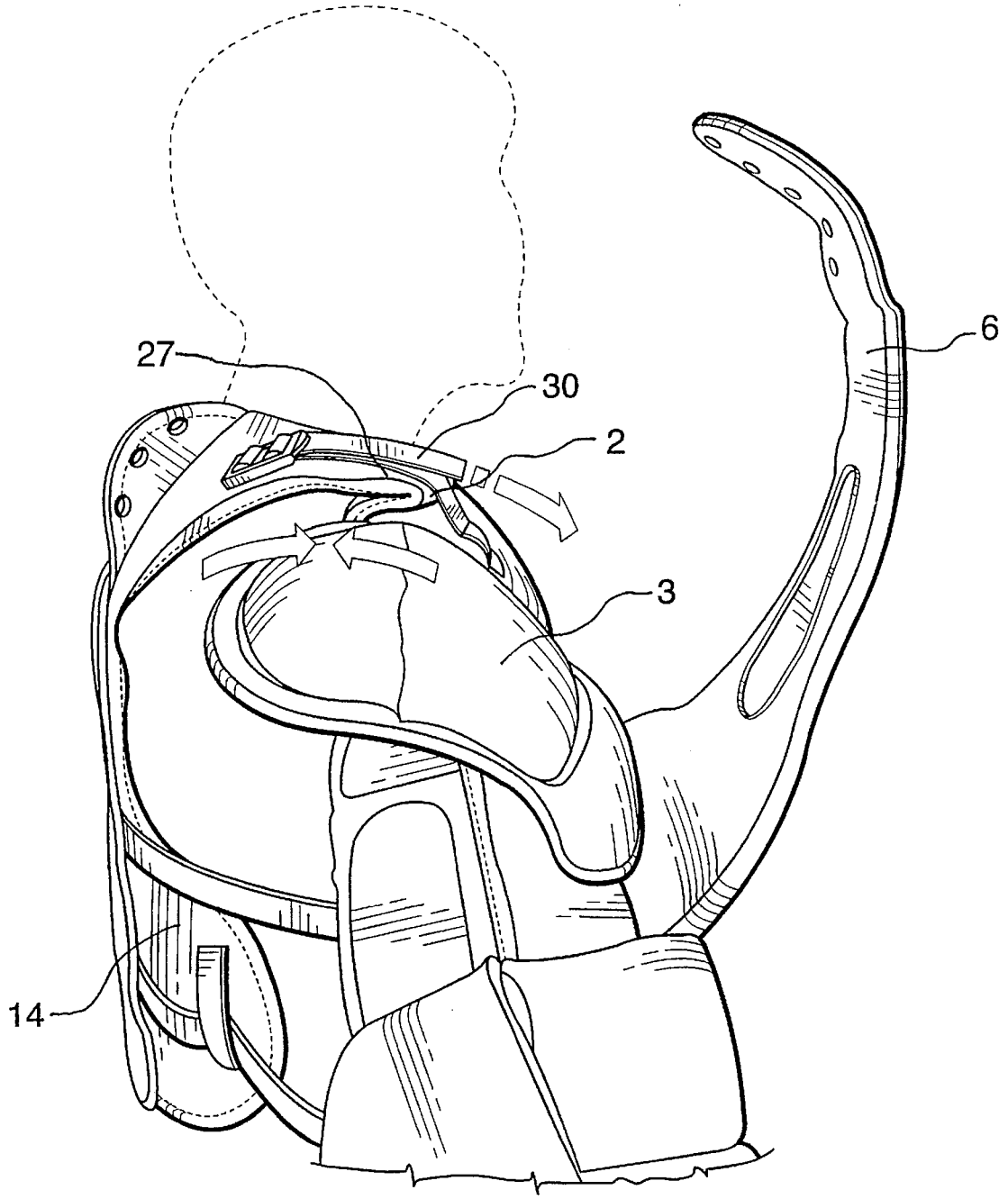
FIG. 8 is an additional partial side view of the protective gear showing the operation of the primary front pad adjustment means.

Referring to FIGS. 6–8, the secondary front pad 6 is secured to the back pad 14 by an appropriate releasable and adjustable fastening means such as a string and holes 21. This fastening means is adjustable as will be described further below.

Attached with flexible connections to the primary front pad 2 are two moulded shoulder caps 3 positionable directly over the player's shoulder.

Still referring to FIG. 1, attached to the primary front pad 2 directly under the shoulder caps 3 are the left and right arm sections of the protective gear 1, referred to as 5 and 7 respectively. These arm sections are again attached using flexible connections such as fabric seams (not shown).

Contrary to what might be expected, the right and left arm sections 5 and 7 are not simply mirror images of each other. Each arm section is uniquely designed for the different tasks that a hockey goaltender uses that arm for.

Figure 2:
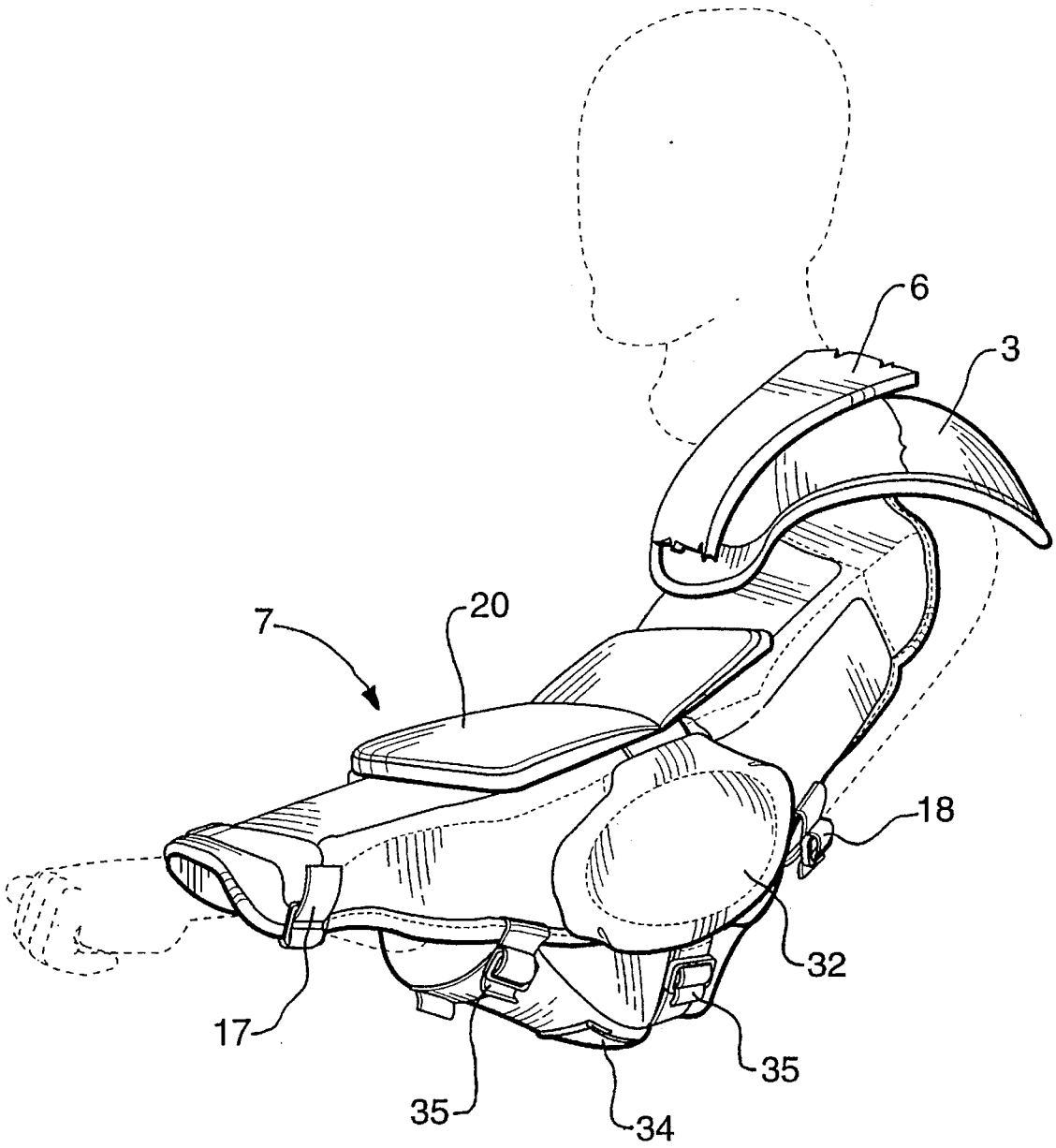
FIG. 2 is a perspective view of the left arm section of the protective gear.
Figure 3:
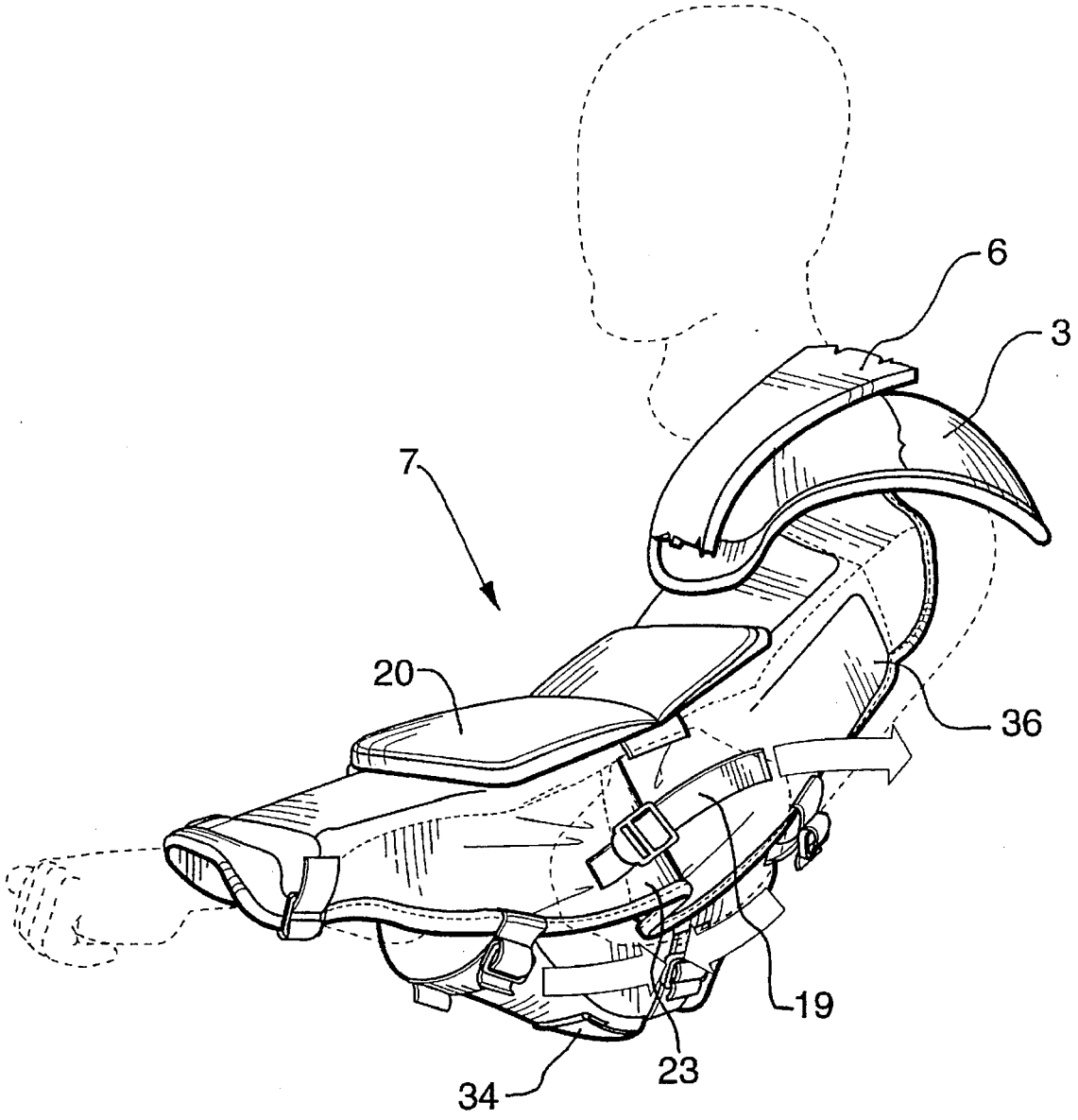
FIG. 3 is a perspective view of the left arm section of the protective gear, showing the location and operation of the arm length adjustment mechanism.

Referring now to FIGS. 2 and 3, the left arm section 7 of the protective gear 1 is shown to be in the form of a "sleeve" extending downwardly towards a player's wrist. Several unique pads are incorporated into, or attached to, the left arm section 7, including the central floater pad 20, the disc pad 32, and the elbow pad 34. Adjustable straps 17, 18 and 35 are provided to fasten the arm section 7 to the player.

Figure 4:
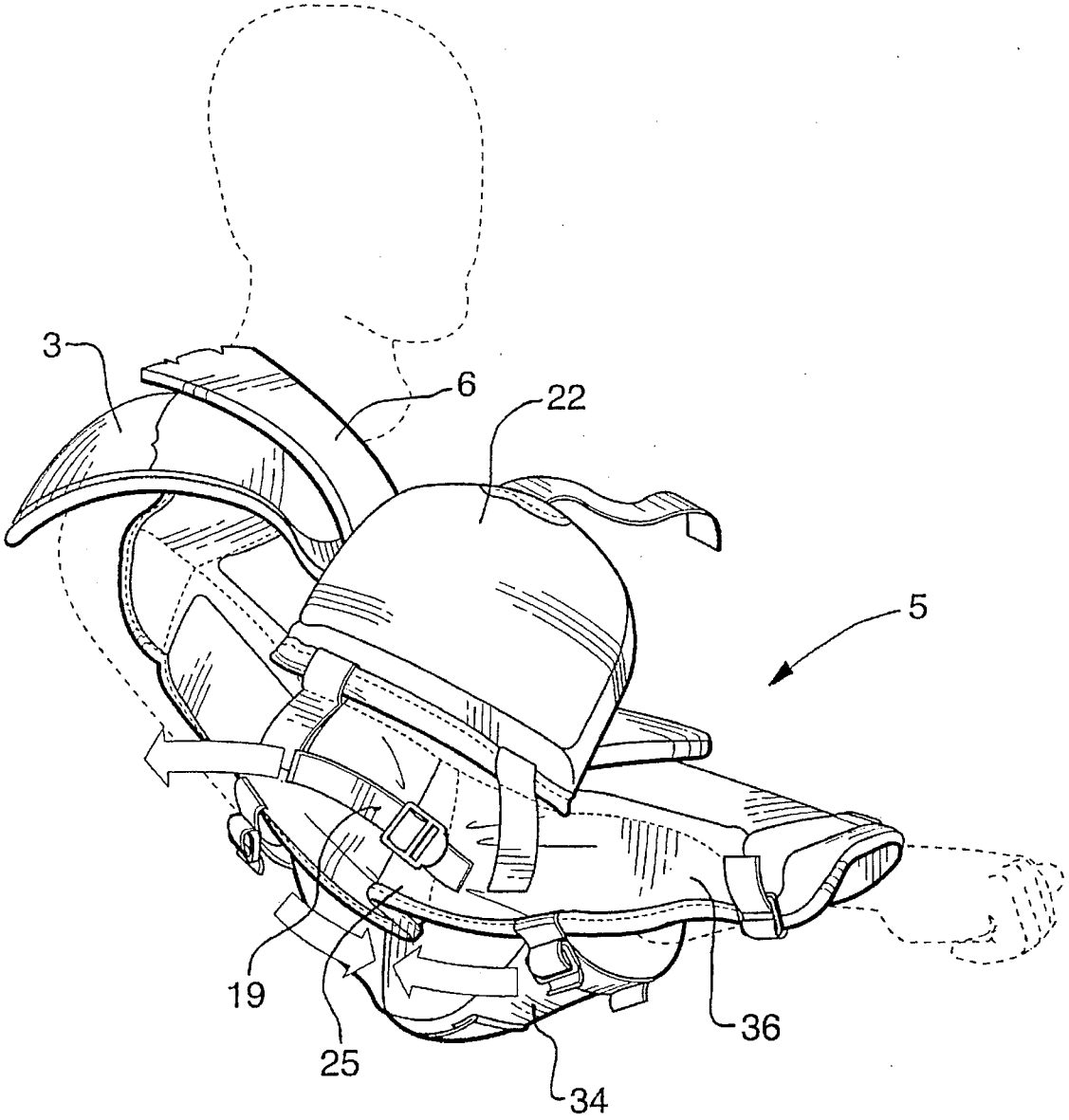
FIG. 4 is a perspective view of the right arm section of the protective gear, showing the location and operation of the arm length adjustment means.
Figure 5:
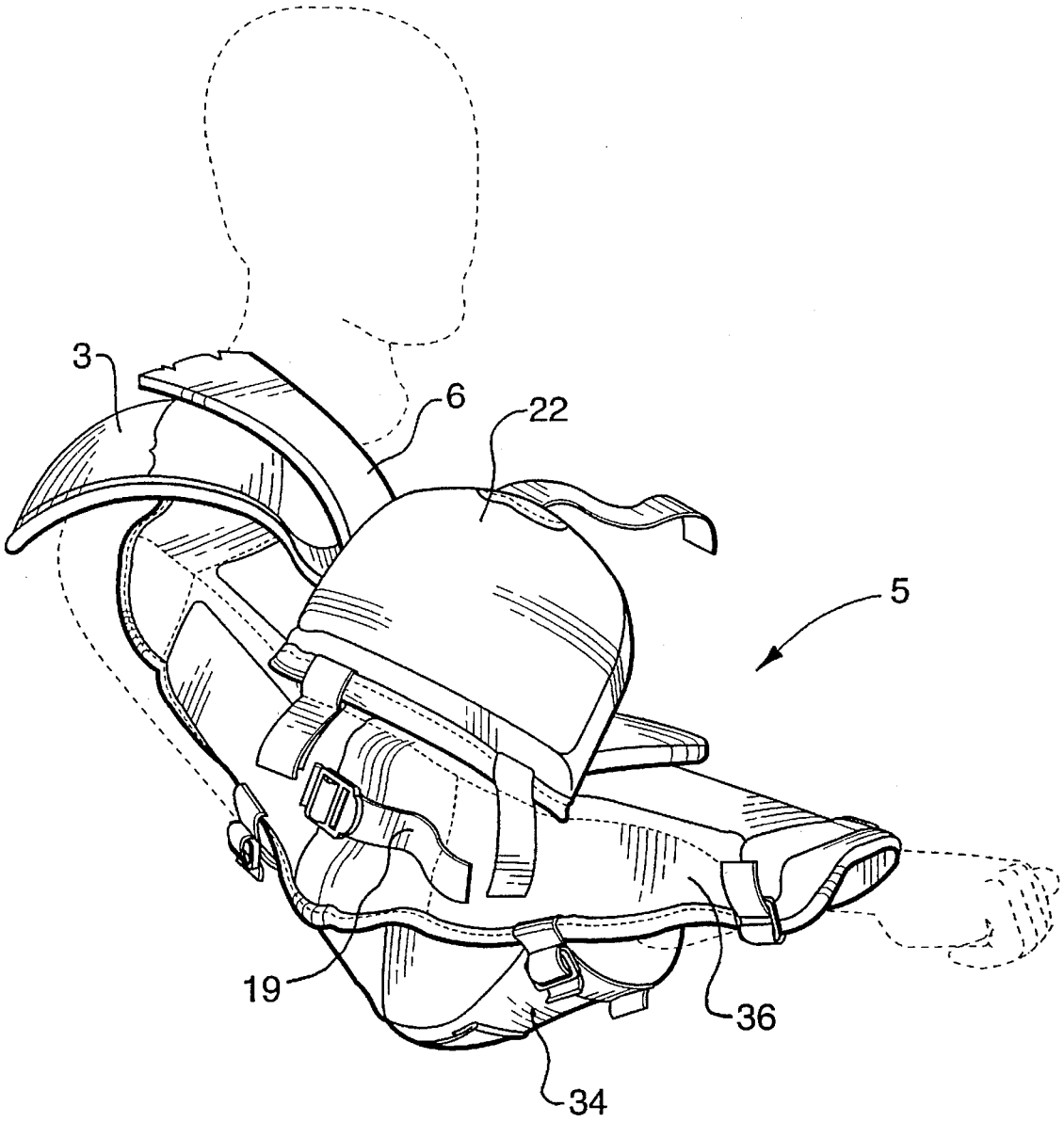
FIG. 5 is a perspective view of the right arm section of the protective gear in an unadjusted position.
Figure 9:
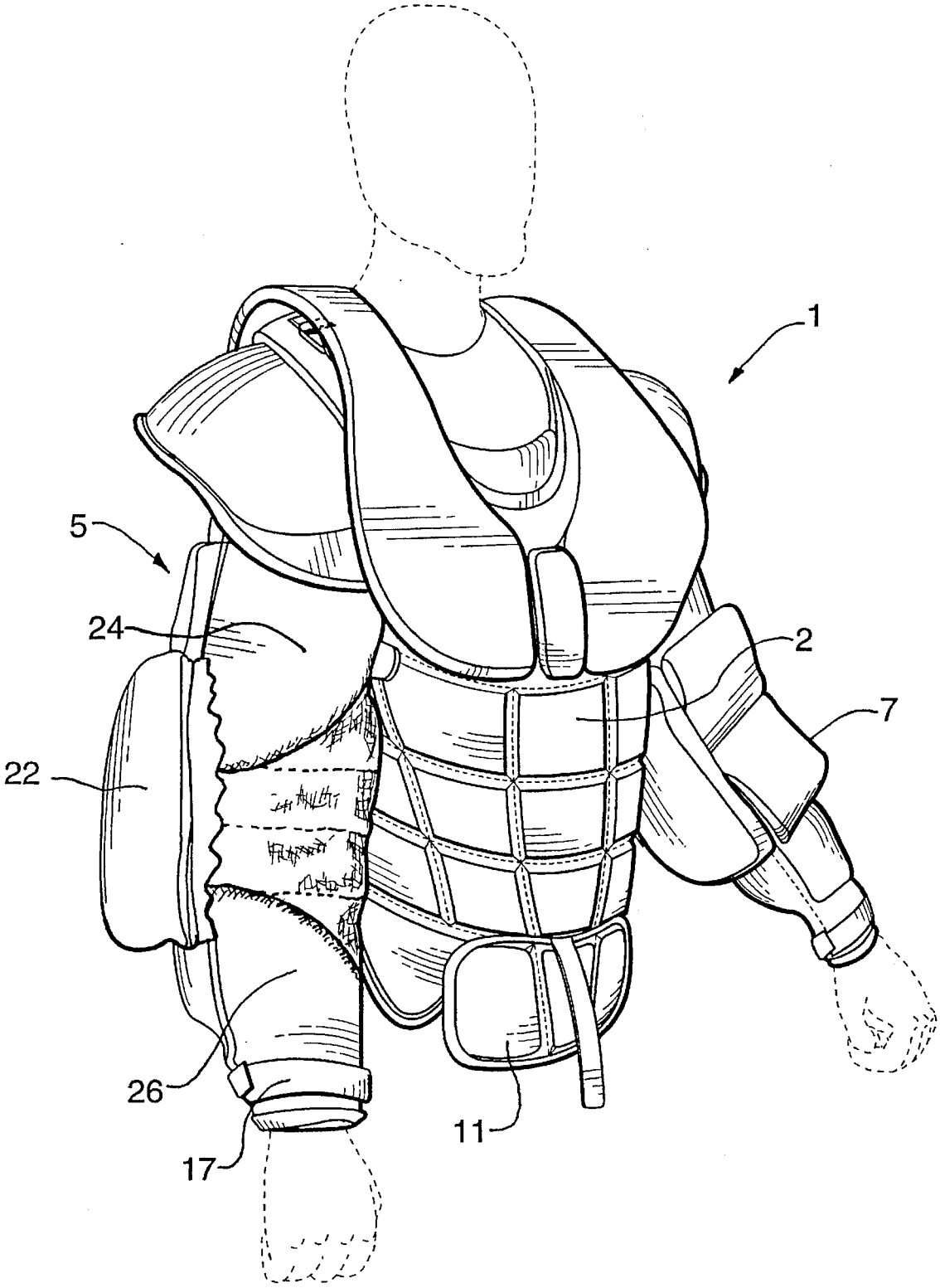
FIG. 9 is a front cut away view of the protective gear showing the shape of the individual pads in the right arm portion of the gear.

Referring now to FIGS. 4, 5 and 9, the right arm section 5 of the protective gear 1 is also shown to be in the form of a "sleeve" extending downwardly towards the player's wrist. Several unique pads are incorporated into, or attached to, the right arm section 5, including the central floater pad 20, the side floater pad 22, and the elbow pad 34. Adjustable straps are provided in similar fashion to the left arm section 7 to allow the right arm section to be secured to the player.

The preferred embodiment shown in the figures is for a right-handed player. Right-handed players typically hold the goal stick in their right hand and use their left hand for the catch glove.

As stated, the right and left arm sections are not mirror images. Referring to FIGS. 1 to 3, the left arm section 7 is shown to have the disc pad 32 on the lateral side of the player's left elbow, with a side floater pad on the medial side of the player's left elbow.

Conversely, the right arm section 5 as shown in FIGS. 1, 4, 5 and 9 is shown to have the side floater pad 22 on the lateral side of the player's elbow, while the disc pad (not shown) is on the medial side.

These differences in padding reflect that the catching hand, which is the left hand in this embodiment, is often held at chest height with the inside of the elbow exposed. Hence, a thicker side floater pad is provided on the medial side of the left elbow. The blocking hand, right hand in this embodiment, is typically held with the lateral side of the elbow exposed, hence the thicker side floater pad is provided on the lateral side of the right elbow, not the medial side.

Referring now to FIG. 9, two integrated pads can be seen to be included in the sleeve of the right arm section 5. These integral pads are the biceps pad 24 and the forearm pad 26, which are positioned over the player's biceps and forearm, respectively.

Both the biceps and forearm pads are present in both arm sections however they are specially configured in the blocking arm. Both pads can be seen to be scalloped, so that the medial corners nearest the elbow have been rounded on both pads. This feature allows the player's blocking arm to move more easily during flexion. In conventional one-piece units these pads may be included, but if so, are not scalloped, and tend to interfere with flexion in that arm. The modification of the biceps pad 24 and forearm pad 26 in this manner has been found to reduce resistance to moderate and severe flexion, thereby improving performance. The corresponding pads on the left arm remain unmodified as the rounding of the corners does somewhat reduce the amount of padding for safety purposes.

In operation, the protective gear 1 is slipped over the player's head and the player's arms are placed in the right and left arm sections. The gear can then be adjusted in several ways to achieve the proper and/or desired fitting for player's of a variety physical statures.

The first, and perhaps most important adjustment made, is adjusting the proper "length" of the primary front pad 2. In the preferred embodiment the adjustment means 30 for the primary front pad 2 is shown in detail in FIGS. 7 and 8. Once the player has placed the "bib-like" portion of the gear over their head, adjustment means, such as straps with retention devices 30 are employed to vary the length and position of the primary front pad 2 in relation to the back pad 14. In this way the primary front pad 2 can be secured to a greater or lesser extent downwardly on the player's body.

The adjustment means 30 shown in the preferred embodiment is quick and easy to use. Simply, each strap is lengthened or shortened whereby the chest portion 4 of the primary front pad 2 "folds upon itself" becoming shorter, or alternately, "unfolds" to its longest position as shown in FIG. 7.

The arrows in FIG. 8 show the relative direction of motion of the differing parts of the chest section 4 of the primary front pad 2 during adjustment.

It is to be noted that while the adjustment means 30 is shown as acting on the primary front pad 2 in this embodiment, other perhaps equally effective configurations are possible. For example, the connection means between the primary front pad 2 and the back pad 14 might be made to include an adjustment means. This is in fact how the adjustment means of the secondary front pad 3 is configured, as will be described. Alternately, an adjustment means could be configured so that the back pad 14 could similarly be made to fold upon itself, causing the relative position of the primary front pad 2 to vary. All such variations are within the scope of this invention.

If the effective length of the primary front pad 2 is adjusted as described above, it may be necessary to also adjust the secondary front pad 6. Referring to FIGS. 6 to 8, the connection or fastening means between the secondary front pad 6 and the back pad 14 can be seen to be a "hole and lace" arrangement.

In the preferred embodiment shown herein, three holes are provided on the back pad 14 while five holes are provided on the secondary front pad 6. The position of the secondary front pad 6 can be varied by using either the upper, middle or lower three holes in the secondary front pad 6.

Thus the fastening means 21 also functions as an adjustment means whereby the position of the secondary pad 6 can be adjusted to accommodate changes to the effective length of the primary pad 2, described above.

The final adjustment means provided for the player involves the adjustment of the "sleeve lengths" for each of the left and right arm sections.

This adjustment is accomplished in a similar fashion to the adjustment of the primary front pad 2, and in the preferred embodiment similar adjustment means are used, being again straps with retention means 19 as shown in FIGS. 4 and 5. Adjustment of said straps causes the fabric sleeve portion of the arm sections to either to flatten out, if the sleeve is to be lengthened, or to fold over upon itself, if the sleeve is to be shortened.

The arm sections are individually adjustable to provide for differing arm lengths, if desired.

It should be appreciated that the above description relates to the preferred embodiment by way of example only. Many variations on the invention will be obvious to those knowledgeable in the field, and such obvious variations are within the scope of the invention as described and claimed, whether or not expressly described.

It should also be appreciated that although the invention is especially designed for use in the sport of ice hockey, and for ice hockey goaltenders in particular, the same general construction could readily by adapted for use other ice hockey players, or in goal equipment in other sports where similar protection is desired. Unitary shoulder and elbow pads for all ice hockey players might be one possible application, and goal equipment for the sport of lacrosse could be another.

The invention as defined in the appended claims is therefore not limited to ice hockey equipment, even though that is the primary intended application. The principle of the invention could be adapted to other sports if desired.

I claim:

1. Protective gear for a sports player, comprising:

a primary front protective pad securable to the player and generally configured to cover a portion of the player's chest and to extend downwardly to cover a portion of the player's abdomen;

a rear protective pad securable to the player and generally configured to cover a portion of the player's back;

said front and rear pads being flexibly connected to each other by a flexible connection to form a single unit; and left and right arm sections flexibly connected to said primary front protective pad, said left and right arm sections being generally configured to cover portions of the player's upper arms and lower arms and to extend downwardly towards the player's wrists, said left and right arm sections comprising adjustment means for adjusting the overall length of each of said arm sections so as to selectively position arm sections relative to the player's arms, wherein either one of said front pad, said rear pad, and said flexible connection comprises adjustment means for adjusting the secured position of the front pad in relation to the rear pad, permitting said front pad to extend to a greater or lesser extent downwardly over the player's abdomen so as to accommodate desired positioning of said front pad.

2. Protective gear as recited in claim 1, further comprising at least one secondary front pad being generally configured to cover the player's upper chest and clavicle areas and extend downwardly towards the player's abdomen, said secondary front pad being flexibly connected to the primary front pad and to the rear protective pad.

3. Protective gear as recited in claim 2, wherein said secondary front pad further comprises an adjustment means to vary the secure position of said secondary front pad in relation to said primary front pad to accommodate adjustments between said primary front pad and said rear protective pad.

4. Protective gear as recited in claim 1, further comprising elbow pads, securable to the player, in each of said left and right arm sections, said elbow pads being flexibly connected with flexible connections to said arm sections, and said elbow pads being generally configured to cover portions of the player's upper arm, lower arm and elbow.

5. Protective gear as recited in claim 1, wherein at least one of said arms sections contains integral biceps and forearm pads, each of said biceps and forearm pads being sufficiently scalloped so as to reduce interference with each other during the player's normal arm flexion, thus permitting a greater range of resistance-free motion for said arm.

* * * * *

UNITED STATES PATENT AND TRADEMARK OFFICE

CERTIFICATE OF CORRECTION

PATENT NO. : 5,623,728
DATED : April 29, 1997
INVENTOR(S) : Steven G. WAGNER

It is certified that error appears in the above-identified patent and that said Letters Patent is hereby corrected as shown below:

IN THE CLAIMS:

Claim 1, line 17, after "selectively position" insert --said--.

Signed and Sealed this

Fourteenth Day of March, 2000

*Attest:*

*Attesting Officer*

Q. TODD DICKINSON

*Commissioner of Patents and Trademarks*